US006290558B1

(12) United States Patent
Erickson

(10) Patent No.: US 6,290,558 B1
(45) Date of Patent: Sep. 18, 2001

(54) EXHAUST ELBOW WITH A WATER TRAP FOR A MARINE PROPULSION SYSTEM

(75) Inventor: James E. Erickson, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/604,147

(22) Filed: Jun. 27, 2000

(51) Int. Cl.[7] ..... B63H 21/32
(52) U.S. Cl. ..... 440/89
(58) Field of Search ..... 181/235, 243; 60/310; 440/89

(56) References Cited

U.S. PATENT DOCUMENTS

| | | | | |
|---|---|---|---|---|
| 3,759,041 | | 9/1973 | North et al. | 60/310 |
| 4,573,318 | | 3/1986 | Entringer et al. | 60/310 |
| 4,589,852 | * | 5/1986 | Price | 440/89 |
| 4,734,071 | | 3/1988 | Zemlicka et al. | 440/89 |
| 4,845,945 | | 7/1989 | Widmer et al. | 60/310 |
| 5,109,668 | | 5/1992 | Lindstedt | 60/310 |
| 5,644,914 | | 7/1997 | Deavers et al. | 60/310 |
| 6,022,254 | | 2/2000 | Neisen | 440/89 |

* cited by examiner

*Primary Examiner*—Ed Swinehart
(74) *Attorney, Agent, or Firm*—William D. Lanyi

(57) ABSTRACT

An exhaust elbow for a marine propulsion exhaust system is provided with a water trap section that defines a water collection cavity. Within the water trap section, a barrier extends downward into the water collection cavity to define first and second exhaust passages. When water begins to collect in the water collection cavity, the cross sectional area of the exhaust passage is reduced and the velocity of exhaust gases passing through the exhaust passage is increased. The water collection cavity is shaped to be easily cleared when exhaust gas pressure increases as the engine speed increases.

20 Claims, 7 Drawing Sheets

EXHAUST ELBOW WITH A WATER TRAP FOR A MARINE PROPULSION SYSTEM

BACKGROUND OF THE INVENTION

1. Field of the Invention

The present invention is generally related to an exhaust elbow for a marine propulsion system and, more particularly, to an exhaust elbow that provides a water collection cavity for the purpose of preventing the flow of water, in a reverse direction, through the wet exhaust system of a marine propulsion engine.

2. Description of the Prior Art

Many different types of exhaust systems for marine propulsion engines are well known to those skilled in the art. Some of these exhaust systems incorporate an exhaust elbow which serves as a transition from the exhaust manifold of an internal combustion engine to an exhaust pipe assembly of a marine vessel.

U.S. Pat. No. 4,573,318 which issued to Entringer et al on Mar. 4, 1986, discloses an exhaust elbow for a marine propulsion system which has an intake exhaust passage extending upwardly from the engine and communicating through a bend with a discharge exhaust passage, and a water jacket having pockets around the exhaust passages for cooling the latter. A central channel extends longitudinally along the exterior of the exhaust passages to guide water therealong to the end of the discharge exhaust passage to mix with exhaust gases. The central channel has a pair of sidewalls extending longitudinally and laterally tapered away from each other at the outer end of the discharge exhaust passage to create an outward draw from the central passage to minimize break-up of longitudinally outward water flow and maintain the end tip of the discharge exhaust passage dry and prevent water ingestion and creeping back into the discharge exhaust passage due to pulsations of the engine. Dam and port structure is also provided enabling faster heating of the exhaust passage and, in turn, minimize the condensation within the elbow which may otherwise ingest back into the engine.

U.S. Pat. No. 4,845,945, which issued to Widmer et al on Jul. 11, 1989 discloses an exhaust elbow trough. A water jacketed exhaust elbow for a marine propulsion system includes an intake exhaust passage communicating with a discharge exhaust passage, a water jacket around the exhaust passages, and a trough member extending longitudinally along a water channel along the exterior of the discharge exhaust passage to guide water therealong to mix with exhaust at the end of the discharge exhaust passage. The trough member extends beyond the end tip of the discharge exhaust passage and has a sharp edge providing a clean parting surface for the coolant water and preventing ingestion of water back into the discharge exhaust passage.

U.S. Pat. No. 5,109,668, which issued to Lindstedt on May 5, 1992, discloses a marine exhaust manifold and elbow. The exhaust assembly includes a manifold portion, an elbow portion, a water jacket portion, and exhaust runner walls, providing a smooth continuous transition of exhaust gas flow from intake exhaust passages in the manifold portion to transfer exhaust passages in the elbow portion around a bend to a discharge exhaust portion, minimizing turbulent flow of exhaust through the manifold portion and elbow portion. Each transfer exhaust passage has its own water supply inlet at the upstream end of the respective intake exhaust passage. An upper vent includes a steam outlet opening in the water jacket at the high point of the elbow portion, and a steam exhaust channel extending along the top exterior of the water jacket portion in a raised bead above and parallel to an upper water flow passage and directing steam to the end of the discharge exhaust passage to mix with water and exhaust thereat. Wall supports assist in directing cooling water up through the water jacket to the top of the elbow bend, and also prevent wall collapse during lost foam stainless steel casting processes.

U.S. Pat. No. 6,022,254, which issued to Neisen on Feb. 8, 2000, describes an exhaust system for inboard/outboard marine propulsion systems. The exhaust system includes intermediate exhaust pipes which are physically separate components than the water separator. A sealed latching mechanism connects an outlet portion of the intermediate exhaust pipes to an inlet portion of the water separator. The sealed latching mechanism is secure yet flexible and allows the orientation of the intermediate exhaust pipe to be adjusted relative to the water separator, thus allowing the exhaust system to be installed and serviced without dismounting or loosening the engine. The intermediate exhaust pipes also have a flared inlet port to facilitate a alignment of the intermediate exhaust pipe at the exhaust elbow.

U.S. Pat. No. 5,644,914, which issued to Deavers et al on Jul. 8, 1997, discloses an exhaust pressure pulsation control apparatus for a marine propulsion system. The apparatus has a front ring and a reflector disk located downstream of the front ring. There is a space between the front ring and the reflector disk that is sufficiently large so that the mixture of water and water cooled exhaust passing through the apparatus does not have a significant pressure drop.

The apparatus attenuates pressure pulsations in the exhaust system, thereby significantly reducing water ingestion through the exhaust system into the engine.

The apparatus does not create significant exhaust back pressure, and typically increases engine maximum power output.

U.S. Pat. No. 4,734,071, which issued to Zemlicka et al on Mar. 29, 1988, discloses a marine engine exhaust assembly. The assembly is provided with water flow path control devices which minimize back pressure. Lower intermediate elbow portions and the respective bullhorn upper legs are formed and joined in a manner to provide a continuous common gas-water passage which is axially linear in a fore-to-aft direction. The common gas-water passages are formed to provide a gradual reduction in cross-sectional area from top to bottom. The wall contours of the intermediate elbows gradually merge from circular at the upper end to generally elliptical at the lower end. In addition, the wall contours of the upper bullhorn legs are generally elliptical at their upper ends for communicating with the intermediate elbows, and gradually merge into a rectangular shape in the area of the bullhorn bends, which continues on to adjacent the bullhorn discharge portion. The leading edges of the gas-water separator plates are formed with a generally V-shaped downstream curve which provides a slicing edge for the water. A gimbal housing has water-carrying lightening pockets which connect from the bullhorn to drain holes in the housing body. The lightening pockets are short and terminate adjacent their respective drain holes. The inner pocket ends are broadly curved in the direction of the respective drain holes.

U.S. Pat. No. 3,759,041, which issued to North et al on Sep. 18, 1973, describes an exhaust water separator for marine engines. Exhaust elbows are provided which force cooling water in the exhaust to the outside by centrifugal action. This water is removed and expelled through the transom.

The patents described above are hereby explicitly incorporated by reference in the description of the present invention.

Modern high output engines of marine propulsion systems require low restriction exhaust systems in order to obtain the maximum horsepower potential from the engines. Unfortunately, exhaust systems for marine propulsion systems known to those skilled in the art typically achieve low restriction exhaust systems with designs that result in low exhaust flow velocities when the engine is operated at reduced speeds. This low exhaust flow velocity increases the susceptibility of the engine to draw cooling water back into the cylinders of the engine. Cooling water is discharged into the exhaust systems in many types of known marine propulsion devices and this discharged water can be pulled back from the exhaust conduits and into the cylinders of the engine, causing severe damage. This phenomenon is referred to as "water reversion" and the characteristic is caused by the high valve overlap used on modem engines as well as other factors. Valve overlap is a term that refers to having both the intake and exhaust valve on each cylinder opened simultaneously for a brief period of time for the purpose of allowing the engine to take on more fuel and air at higher engine speeds. While this valve overlap is advantageous for producing more power at higher speeds, it allows intake manifold vacuum to cross over into the exhaust system at idle and low speeds and can result in water being drawn backward within the exhaust system and into the cylinders of the engine. The lower exhaust flow velocities, which typically occur at reduced engine speeds in modern exhaust systems, makes it easier for the exhaust and water to reverse direction and be drawn back into the engine. The problem of water reversion typically occurs at idle and low engine speeds and can be very harmful to the engine.

It would therefore be significantly advantageous if an exhaust system could be provided for a marine propulsion system in which a low restriction exhaust passage could be provided without the disadvantageous characteristics described above.

SUMMARY OF THE INVENTION

In an exhaust system made in accordance with a preferred embodiment of the present invention, the marine propulsion exhaust system comprises an exhaust elbow that, in turn, defines an exhaust path which comprises an exhaust inlet, an exhaust outlet, and a water trap section disposed in fluid communication between the exhaust inlet and the exhaust outlet. The water trap section defines a water collection cavity. A barrier is disposed in the exhaust path and within the water trap section and extends downwardly into the water collection cavity. A first exhaust passage within the exhaust path, defined by the barrier, is located between the exhaust inlet and the exhaust outlet. A second exhaust passage within the exhaust path, defined by the barrier, is also located between the exhaust inlet and the exhaust outlet. The second exhaust passage is located at least partially within the water collection cavity and below the first exhaust passage, wherein exhaust gas can flow through both the first and second exhaust passages when water which is trapped within the water collection cavity is less than a predefined volume and wherein exhaust gas can flow at least through the first exhaust passage when water which is trapped within the water collection cavity is greater than the predefined volume.

When in use, an exhaust manifold of an engine is connected in fluid communication with the exhaust inlet of the exhaust elbow. Furthermore, an exhaust conduit extends through the transom of a boat, wherein the exhaust conduit is connected in fluid communication with the exhaust outlet of the exhaust elbow. The exhaust elbow can have a water jacket formed therein. The water jacket at least partially surrounds the exhaust inlet, the exhaust outlet, and the water trap section. The water jacket can be connected in fluid communication with the exhaust path in the general vicinity of the exhaust outlet and, in certain applications, downstream from the water trap section.

It should be understood that the exhaust system of the present invention provides a barrier disposed within the water trap section and extending downwardly into the water collection cavity in such a way that the barrier defines an exhaust passage having a total cross sectional area which has a variable magnitude. The magnitude is defined by the amount of liquid within the water collection cavity. More specifically, the magnitude of the cross sectional area of the exhaust passage is greatest when the amount of liquid within the water collection cavity is least and, conversely, the magnitude of the cross sectional area is least when the amount of liquid within the water collection cavity is greatest. In other words, as the water collects within the water collection cavity, the increase in the volume of water within the cavity decreases the cross sectional area of the exhaust passage and, conversely, as water is removed from the water collection cavity, the magnitude of the cross sectional area of the exhaust passage increases. This inverse relationship between the amount of water in the water collection cavity and the magnitude of the cross sectional area of the exhaust passage provides significant benefits, as will be described in greater detail below.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
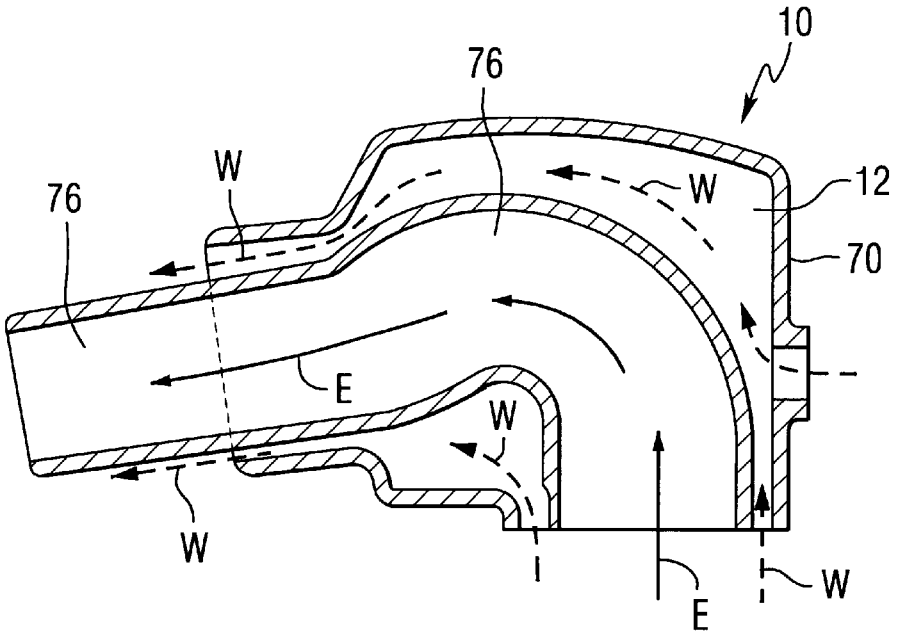
FIG. 1 PRIOR ART
FIGS. 1 and 2 show exhaust elbows known to those skilled in the art.

Throughout the description of the preferred embodiment of the present invention, like components will be identified by like reference numerals.

Figure 2:
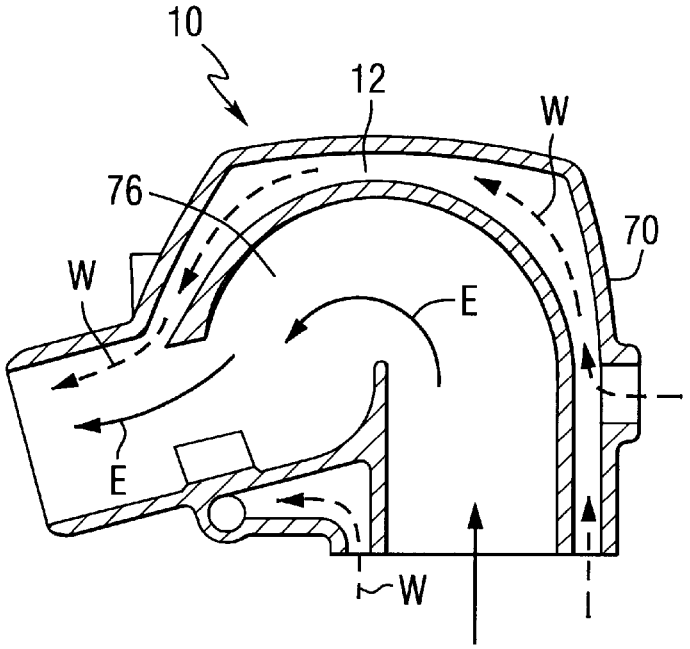
FIG. 2 PRIOR ART

FIGS. 1 and 2 show two known types of exhaust elbows 10 used in wet exhaust systems. In FIGS. 1 and 2, the path of exhaust gas is represented by solid line arrows E and the path of cooling water is represented by dashed line arrows W. The water flows in a jacket 12 that generally surrounds the exhaust passage and is eventually mixed with the exhaust E as the exhaust gases exit the exhaust elbow 10.

Although there are various styles of exhaust elbows 10 known to those skilled in the art, the two cross sectional views of FIGS. 1 and 2 represent a typical illustration of known exhaust elbows.

Figure 3:
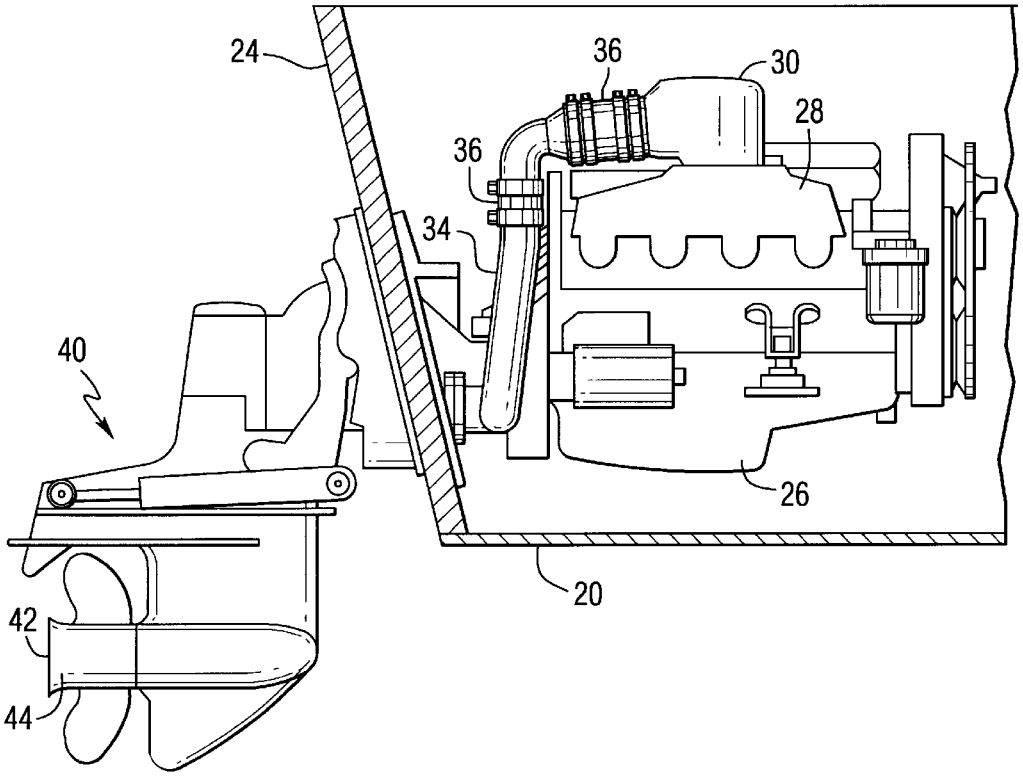
FIG. 3 shows a marine vessel with an engine and outboard drive equipped with an exhaust elbow connected between an exhaust conduit and an exhaust manifold.

FIG. 3 shows a boat 20 with a transom 24, an engine 26, an exhaust manifold 28, and an exhaust elbow 30. Exhaust gases are conducted from the cylinders of the engine 26 by the exhaust manifold 28 and directed through an exhaust passage formed within the exhaust elbow 30. The exhaust then flows through an exhaust conduit 34 that comprises several types of coupling members 36. The exhaust is then directed through the transom 24 and through the outboard drive 40, eventually being directed through the hub 42 of a propeller 44. The exhaust elbow 30 made in accordance with the present invention defines an exhaust path which, in turn, comprises an exhaust inlet, an exhaust outlet, and a water trap section.

Figure 4:
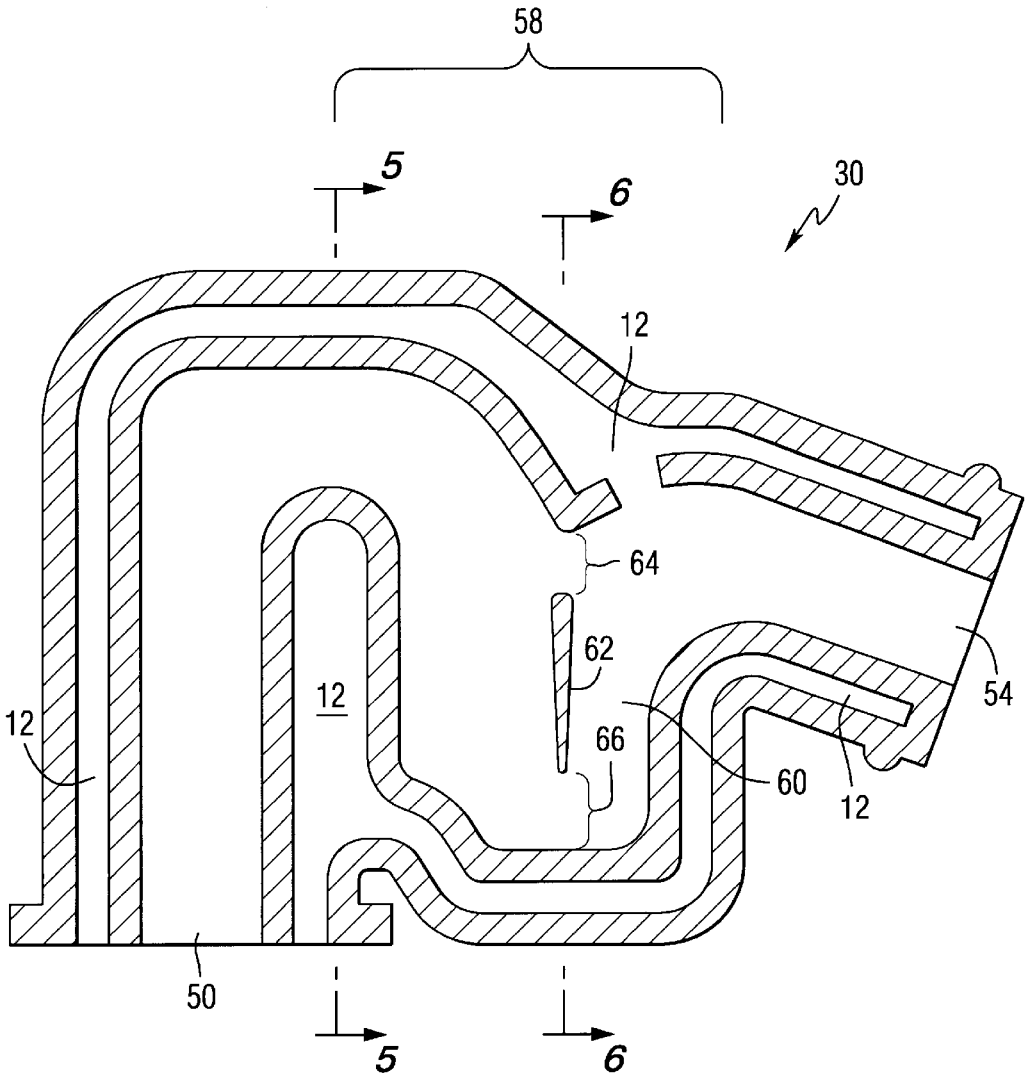
FIG. 4 is a sectional view of an exhaust manifold made in accordance with the present invention.

FIG. 4 is a sectional view of an exhaust elbow 30 shown in FIG. 3 and made in accordance with the present invention. The exhaust path formed within the exhaust elbow 30 comprises an exhaust inlet 50, an exhaust outlet 54, and a water trap section 58 disposed in fluid communication between the exhaust inlet 50 and the exhaust outlet 54. The water trap section 58 defines a water collection cavity 60. A barrier 62 is disposed within the water trap section and extends downwardly into the water collection cavity 60. A first exhaust passage 64 is defined by the barrier 62 between the exhaust inlet 50 and the exhaust outlet 54. A second exhaust passage 66 is also defined by the barrier 62 and located between the exhaust inlet 50 and the exhaust outlet 54. The second exhaust passage is located at least partially within the water collection cavity 60 and below the first exhaust passage 54. This construction allows exhaust gas to flow through both the first 64 and second 66 exhaust passages from the exhaust inlet 50 to the exhaust outlet 54 when the water which is trapped within the water collection cavity 60 is less than a predefined volume. In addition, exhaust gas can flow at least through the first exhaust passage 64 when the water which is trapped within the water collection cavity 60 is greater than that predefined volume.

Figure 5:
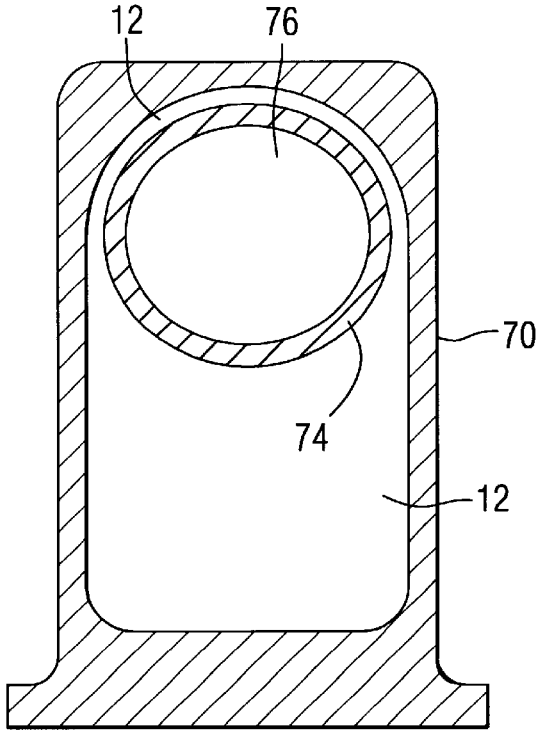
FIGS. 5 and 6 are sectional views of FIG. 4.

FIG. 5 is a section view of FIG. 4. The outermost housing 70 defines a water jacket 12 that surrounds an inner housing 74 that defines an exhaust conduit 76. The water jacket 12 provides cooling for the inner housing 74 which conducts hot exhaust gases from the exhaust manifold of the engine.

Figure 6:
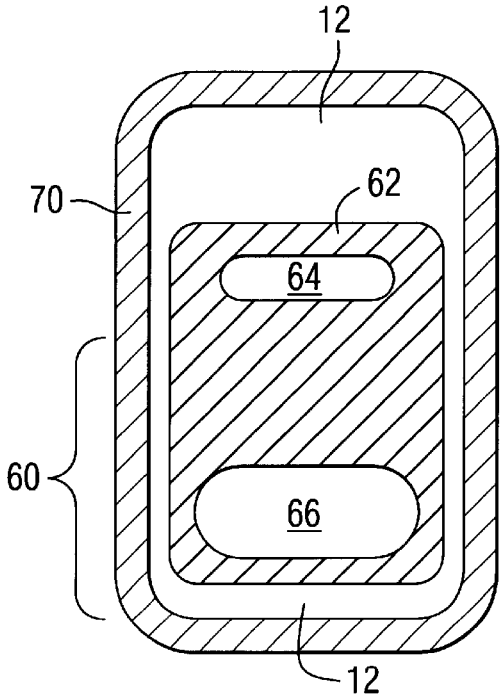

FIG. 6 is a section view of the exhaust elbow 30 shown in FIG. 4. The barrier 62 defines the first exhaust passage 64 and the second exhaust passage 66 and is, in turn, surrounded by the water jacket 12. The entire view of FIG. 6 is contained within the water trap section 58 and the portion indicated by reference numeral 60 in FIG. 6 illustrates the water collection cavity portion of the Figure.

As can be seen, the barrier 62 extends downward into the water collection cavity 60. It can also be seen that the second exhaust passage 66 is located below the first exhaust passage 64 and, when water collects within the water collection cavity 60, a portion or all of the second exhaust passage 66 can be underwater.

Figure 7:
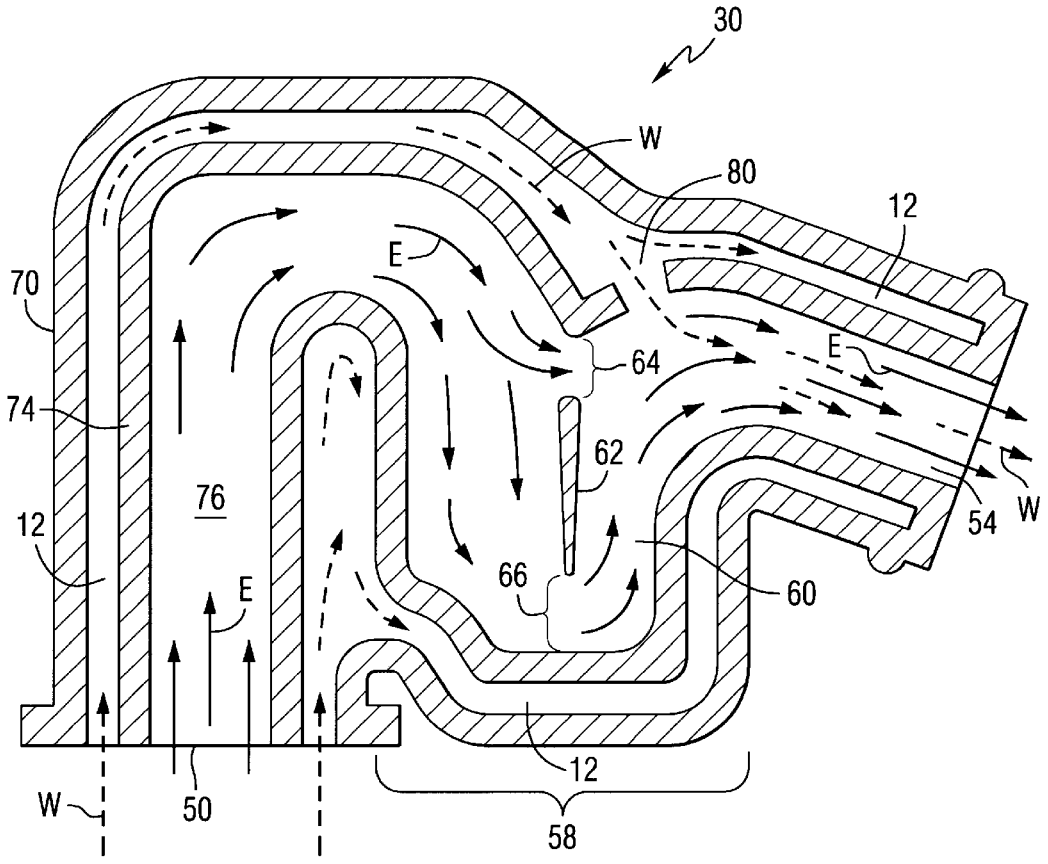
FIG. 7 shows the present invention with exhaust gas and water flowing through the exhaust elbow.

FIG. 7 shows the view of FIG. 4, but with arrows E and W added to show a flow of exhaust and water respectively, within the exhaust path defined by the exhaust elbow 30. As represented by the solid line arrows E, the exhaust flows into the exhaust inlet 50 from an exhaust manifold of the engine and continues to flow along the exhaust path defined by the exhaust elbow 30. It moves from the exhaust inlet 50 to the water trap section 58, through both the first exhaust passage 64 and the second exhaust passage 66, and then out of the exhaust elbow 30 through the exhaust outlet 54. Water, as represented by dashed line arrows W flows through the water jacket 12 surrounding the exhaust path and, through opening 80, is injected into the exhaust stream downstream from the water trap section 58 and downstream from the exhaust inlet 50. It is known to those skilled in the art that injection of water W into the exhaust flow E proves an efficient way of disposing the cooling water and simultaneously cooling the exhaust stream.

With continued reference to FIG. 7, it should be noted that no water is shown within the water collection cavity 60. As a result, both the first and second exhaust passages, 64 and 66, are completely opened and able to carry the exhaust gases through them. It should be understood, however, that as water is collected within the water collection cavity 60 of the water trap section 58, the second exhaust passage 66 will begin to close because of the presence of water that blocks that opening of the barrier 62. As this water rises to close the second exhaust passage 66, the total flow of exhaust entering the exhaust inlet 50 must pass through the first exhaust passage 64 which remains open. As a result, the velocity of exhaust gas passing through the first exhaust passage must increase significantly to accommodate the total exhaust flow. This increased velocity is advantageous because it reduces the opportunity of exhaust gas and water to be drawn backward toward the exhaust inlet 50 and into the engine because of the valve overlap described above. As a result, the velocity of exhaust gas passing through the first passage 64 is increased when the engine is operating at idle speeds if water is collected within the water collection cavity 60. The high velocity of exhaust passing through the first exhaust passage 64 promotes better mixing of water with the exhaust as the water flows through opening 80 and this avoids hot spots in the exhaust structure downstream from opening 80.

Figure 8:
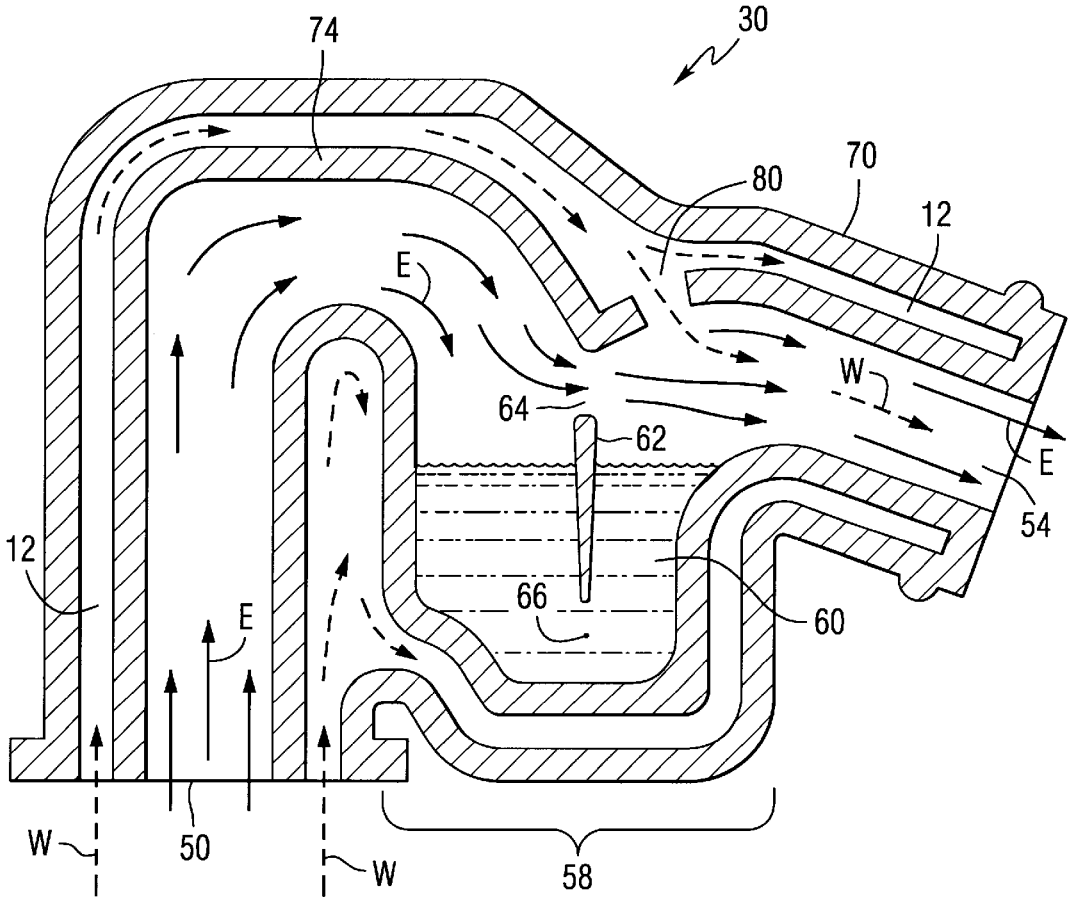
FIG. 8 shows the exhaust elbow of the present invention with water collected within its water collection cavity.

FIG. 8 shows the exhaust elbow 30 with a considerable quantity of water collected in the water collection cavity 60. This water blocks the second exhaust passage 66, but leaves the first exhaust passage 64 clear and able to conduct exhaust through it. Since the exhaust flowing into the exhaust inlet 50 remains unchanged, the velocity of exhaust passing through the first exhaust passage 64 must increase to accommodate this flow through the reduced cross sectional area as a result of the blockage of the second exhaust passage 66. This increased velocity performs the advantageous functions described above. It can be seen in FIG. 8 that the barrier 66 with its first and second exhaust passages, 64 and 66, performs the function of making the total cross sectional area of the first and second exhaust passages decrease with increasing quantities of water within the water collection cavity 60. As the water level within the water collection cavity 60 is lowered, eventually the total exhaust passage cross sectional area will increase as the second exhaust passage 66 is first partially opened and then completely opened. It should also be understood that when the engine begins to operate at higher speeds, the pressure of the exhaust gas entering the exhaust inlet 50 increases substantially and is capable of forcing all of the water within the water collection cavity 60 out the exhaust outlet 54 to be discharged back through the transom and the outboard drive into the body of water in which the marine vessel is operated.

Figure 9:
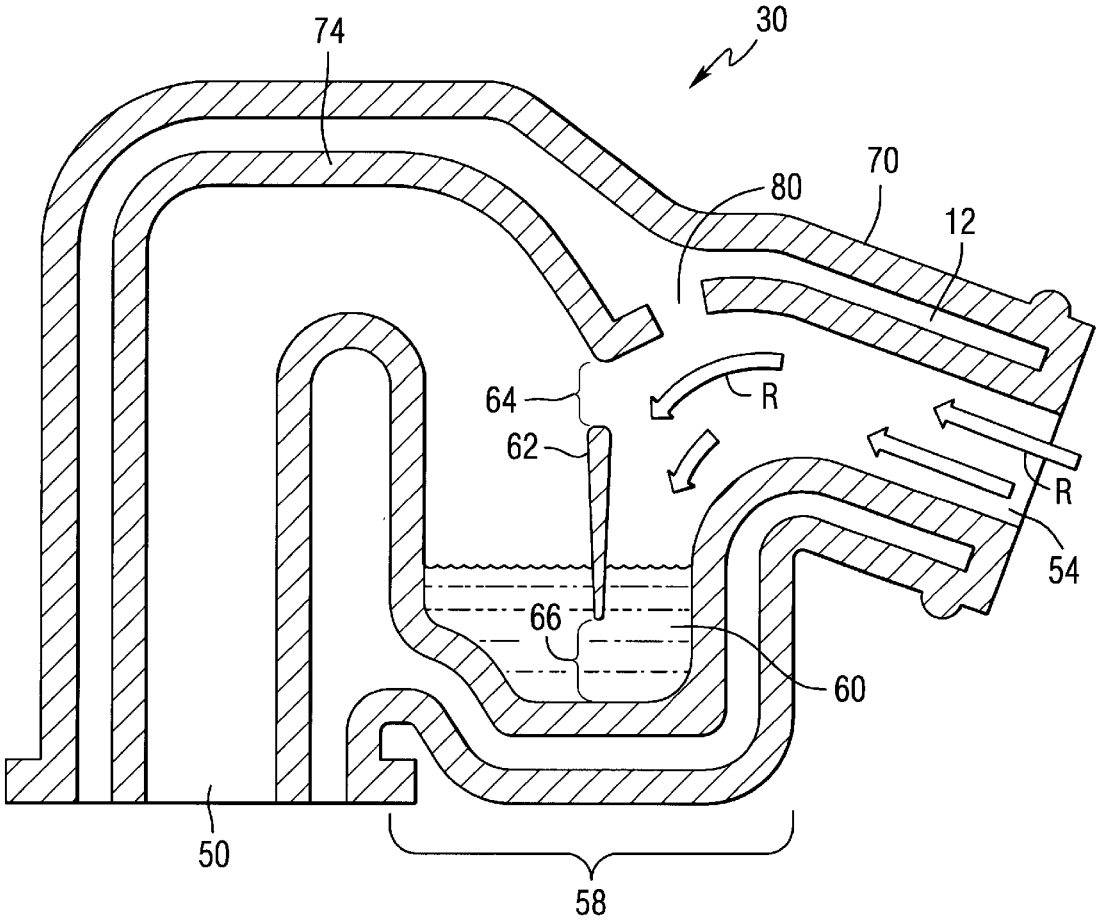
FIG. 9 shows the operation of the present invention during a period of time in which water is flowing at a reverse direction through the exhaust system.

FIG. 9 shows the exhaust elbow 30 under circumstances where a reverse flow of water, represented by arrows R occurs under certain circumstances. This reverse flow of water R can occur when the marine vessel is being launched at a launching ramp, when the engine is rapidly decelerated, when the engine is shut down suddenly when operating at high speed, and other circumstances that can draw water upward through the exhaust system and into the exhaust elbow 30 through the exhaust outlet 54. When this potentially damaging situation occurs, the gooseneck design of the exhaust elbow dampens the reverse flow R because of the increased tortuous path provided by the present invention and also because the initial collection of water within the water collection cavity 60 reduces the cross sectional area of the exhaust passage through which the water could otherwise flow with little resistance. During these momentary conditions when water would otherwise be drawn in a reverse direction through the exhaust system, the water trap section 58, with its water collection cavity 60 and barrier 62, significantly reduces the chance for water to continue its reverse flow completely through the exhaust elbow 30.

With reference to FIGS. 3–9, it can be seen that the present invention provides a mechanism by which water collected in the water collection cavity 60 decreases the cross sectional area of the exhaust passage as the level of water rises. As water begins to collect in the bottom of the water collection cavity 60, the second exhaust passage 66 is reduced because of the rising water. Eventually, when sufficient water is collected in the water collection cavity 60 to completely close the second exhaust passage 66, all of the exhaust is forced to flow through the first exhaust passage 64. This reduced cross sectional area increases the velocity of the exhaust and provides a beneficial characteristics described above with regard to water that is injected through opening 80. The structure of the water trap section 58 is such that increased pressure provided by the exhaust flow at increased engine speeds is sufficient to blow out the water from the water collection cavity 60. As a result, water movement through the exhaust system toward the cylinders of the engine is significantly reduced along with the potential damage that this water reversion can cause.

Although the present invention has been described with considerable detail and illustrated to show a specific embodiment, it should be understood that alternative embodiments are also within its scope.

I claim:

1. An exhaust system for a marine propulsion device, comprising:

an exhaust elbow comprising an exhaust path which comprises an exhaust inlet, an exhaust outlet, and a water trap section disposed in fluid communication between said exhaust inlet and said exhaust outlet, said water trap section defining a water collection cavity;

a barrier disposed within said water trap section and extending downwardly into said water collection cavity;

a first exhaust passage, defined by said barrier, between said exhaust inlet and said exhaust outlet; and a second exhaust passage, defined by said barrier, between said exhaust inlet and said exhaust outlet, said second exhaust passage being located at least partially within said water collection cavity and below said first exhaust passage, wherein exhaust gas can flow through both said first and second exhaust passages, from said exhaust inlet to said exhaust outlet, when water trapped within said water collection cavity is less than a predefined volume and wherein exhaust gas can flow at least through said first exhaust passage, from said exhaust inlet to said exhaust outlet, when water trapped within said water collection cavity is greater than said predefined volume.

2. The exhaust system of claim 1, further comprising:

an exhaust manifold connected in fluid communication with said exhaust inlet of said exhaust elbow.

3. The exhaust system of claim 2, further comprising:

an engine adapted to be connected in fluid communication with said exhaust manifold.

4. The exhaust system of claim 1, further comprising:

a boat having a transom; and an exhaust conduit adapted to extend through said transom, said exhaust conduit being connected in fluid communication with said exhaust outlet of said exhaust elbow.

5. The exhaust system of claim 1, wherein:

said exhaust elbow has a water jacket formed therein and at least partially surrounding said exhaust inlet, said exhaust outlet, and said water trap section.

6. The system of claim 5, wherein:

said water jacket is connected in fluid communication with said exhaust path downstream from said exhaust inlet.

7. The system of claim 6, wherein:

said water jacket is connected in fluid communication with said exhaust path downstream from said water trap section.

8. An exhaust system for a marine propulsion device, comprising:

an exhaust elbow comprising an exhaust path formed therein, said exhaust path comprising an exhaust inlet, an exhaust outlet, and a water trap section disposed in fluid communication between said exhaust inlet and said exhaust outlet, said water trap section defining a water collection cavity; and a barrier disposed within said water trap section and extending downwardly into said water collection cavity, said barrier defining an exhaust passage having a cross sectional area which has a magnitude that is defined by the amount of liquid within said water collection cavity, said magnitude of said cross sectional area being greatest when said amount of liquid within said water collection cavity is least and said magnitude of said cross sectional area being least when said amount of liquid within said water collection cavity is greatest.

9. The exhaust system of claim 8, wherein:

said exhaust passage comprises a first exhaust passage, defined by said barrier, between said exhaust inlet and said exhaust outlet and a second exhaust passage, defined by said barrier, between said exhaust inlet and said exhaust outlet, said second exhaust passage being located at least partially within said water collection cavity and below said first exhaust passage, wherein exhaust gas can flow through both said first and second exhaust passages, from said exhaust inlet to said exhaust outlet, when water trapped within said water collection cavity is less than a predefined volume and wherein exhaust gas can flow at least through said first exhaust passage, from said exhaust inlet to said exhaust outlet, when water trapped within said water collection cavity is greater than said predefined volume.

10. The exhaust system of claim 9, further comprising:

an exhaust manifold connected in fluid communication with said exhaust inlet of said exhaust elbow.

11. The exhaust system of claim 10, further comprising:

an engine adapted to be connected in fluid communication with said exhaust manifold.

12. The exhaust system of claim 11, further comprising:

a boat having a transom; and an exhaust conduit adapted to extend through said transom, said exhaust conduit being connected in fluid communication with said exhaust outlet of said exhaust elbow.

13. The exhaust system of claim 12, wherein:

said exhaust elbow has a water jacket formed therein and at least partially surrounding said exhaust inlet, said exhaust outlet, and said water trap section.

14. The system of claim 13, wherein:

said water jacket is connected in fluid communication with said exhaust path downstream from said exhaust inlet.

15. The system of claim 14, wherein:

said water jacket is connected in fluid communication with said exhaust path downstream from said water trap section.

16. An exhaust system for a marine propulsion device, comprising:

an exhaust elbow comprising an exhaust path formed therein, said exhaust path comprising an exhaust inlet, an exhaust outlet, and a water trap section disposed in fluid communication between said exhaust inlet and said exhaust outlet, said water trap section defining a water collection cavity;

a barrier disposed within said water trap section and extending downwardly into said water collection cavity, said barrier defining an exhaust passage having a cross sectional area which has a magnitude that is defined by the amount of liquid within said water collection cavity, said magnitude of said cross sectional area being greatest when said water collection cavity is least and said magnitude of said cross sectional area being least when said water collection cavity is greatest;

an exhaust manifold connected in fluid communication with said exhaust inlet of said exhaust elbow; and an engine adapted to be connected in fluid communication with said exhaust manifold.

17. The exhaust system of claim 16, wherein:

said exhaust passage comprises a first exhaust passage, defined by said barrier, between said exhaust inlet and said exhaust outlet and a second exhaust passage, defined by said barrier, between said exhaust inlet and said exhaust outlet, said second exhaust passage being located at least partially within said water collection cavity and below said first exhaust passage, wherein exhaust gas can flow through both said first and second exhaust passages, from said exhaust inlet to said exhaust outlet, when water trapped within said water collection cavity is less than a predefined volume and wherein exhaust gas can flow at least through said first exhaust passage, from said exhaust inlet to said exhaust outlet, when water trapped within said water collection cavity is greater than said predefined volume.

18. The exhaust system of claim 17, further comprising:

a boat having a transom; and an exhaust conduit adapted to extend through said transom, said exhaust conduit being connected in fluid communication with said exhaust outlet of said exhaust elbow.

19. The exhaust system of claim 18, wherein:

said exhaust elbow has a water jacket formed therein and at least partially surrounding said exhaust inlet, said exhaust outlet, and said water trap section.

20. The system of claim 19, wherein:

said water jacket is connected in fluid communication with said exhaust path downstream from said exhaust inlet and downstream from said water trap section.

* * * * *